United States Patent [19]

Thuerman

[11] Patent Number: 4,941,315

[45] Date of Patent: Jul. 17, 1990

[54] WEAR RESISTANT CHAIN FOR TRENCHERS

[75] Inventor: John H. Thuerman, West Allis, Wis.

[73] Assignee: Rexnord Corporation, Milwaukee, Wis.

[21] Appl. No.: 310,240

[22] Filed: Feb. 13, 1989

[51] Int. Cl.[5] ..... F16G 13/08

[52] U.S. Cl. ..... 59/78; 59/5; 59/6; 59/8; 59/93; 299/82

[58] Field of Search ..... 59/4, 5, 6, 8, 78, 84, 59/80, 93; 30/381, 383, 382; 299/82, 83, 84; 83/830, 831, 832

[56] References Cited

U.S. PATENT DOCUMENTS

| | | | |
|---|---|---|---|
| 3,754,341 | 8/1973 | Caldwell et al. | 30/383 |
| 3,830,054 | 8/1974 | Tamamura et al. | 59/84 |
| 3,854,363 | 12/1974 | Merkell et al. | 83/830 |
| 3,913,979 | 10/1975 | Strauss et al. | 299/84 |
| 4,363,178 | 12/1982 | Erickson | 83/831 |
| 4,404,761 | 9/1983 | Paulin et al. | 299/82 |
| 4,509,323 | 4/1985 | Ledvina | 59/8 |
| 4,562,761 | 1/1986 | Alexander | 83/830 |
| 4,660,611 | 4/1987 | Gockley et al. | 59/84 |

FOREIGN PATENT DOCUMENTS

| | | | |
|---|---|---|---|
| 213746 | 6/1968 | U.S.S.R. | 299/82 |

OTHER PUBLICATIONS

"Metals Handbook", American Society for Metals, vol. 2, pp. 167, 168, 1964.

*Primary Examiner*—David Jones

*Attorney, Agent, or Firm*—Michael, Best & Friedrich

[57] ABSTRACT

A sidebar is provided for a trenching chain. The sidebar has an inner edge which slides along a boom of a trenching machine, when the trenching chain is in use. The sidebar is induction hardened through a portion thereof extending from the inner edge, for increased resistance to wear due to friction.

47 Claims, 1 Drawing Sheet

WEAR RESISTANT CHAIN FOR TRENCHERS

FIELD OF THE INVENTION

The invention relates to chains and more particularly to chains for trenching machines and other similar applications.

BACKGROUND OF THE INVENTION

Trenching machines commonly include a digging chain supported on a boom. In use, the boom extends from the machine and downwardly, and the digging chain is fastened to and around the boom. The digging chain supports a plurality of spaced apart digging or cutting teeth which contact the ground to be trenched.

During operation of the trencher, as the chain moves continuously along the edge of the boom, the frictional contact between the chain and surfaces of the boom causes wear of the chain links, and this wear is aggravated as dirt and grit comes between the chain and the boom during trenching.

Additionally, during operation of the trencher, if the cutters encounter obstructions or hard material, backflexing of the chain links tends to occur as cutters supported by the links contact the surface being trenched. This backflexing of the chain links and cutters tends to reduce the effectiveness of the cutters and may also cause increased friction between certain surfaces of the chain and the boom of the trencher and uneven chain link wear.

While in some prior art chain link sidebars a central portion of the edge that slidingly contacts a supporting surface has been induction hardened in an effort to reduce chain wear, the prior art does not provide a sidebar with effective means to reduce chain wear at the forward and rearward ends of the edge of the chain link where frictional wear is greatest.

SUMMARY OF THE INVENTION

A chain is provided having a plurality of chain links joined together by chain pins. At least one of the chain links includes a sidebar which has a first edge adapted to be supported in sliding contact with a supporting surface. The first edge is generally linear and extends in the direction of movement of the chain with respect to the support surface. The sidebar includes an opposite edge spaced from and generally parallel to the first edge, a trailing end having a first pitch hole passing through it, and a leading end having a second pitch hole passing through it. At least one of the leading end and the trailing end of the sidebar include an induction hardened portion adjacent the first edge.

In one embodiment of the invention the induction hardened portion of the sidebar further extends between the first edge and a line extending generally parallel to the first edge. The line is spaced between the pitch holes and the first edge.

In one embodiment of the invention, the chain sidebars also have a configuration which provides reduced backflexing of chain links when a load is applied to the cutters supported by the chain.

These and other features and advantages of the invention will become apparent to those skilled in the art upon review of the following detailed description of the preferred embodiment of the invention, which is given by way of example only, reference being made to the appended drawings.

DESCRIPTION OF A PREFERRED EMBODIMENT

Figure 1:
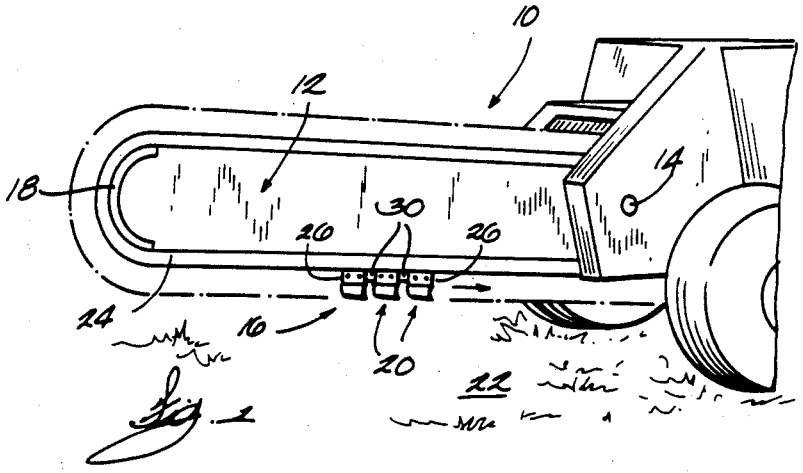
FIG. 1 is a perspective view of a trenching machine embodying the invention.

Referring to FIG. 1, a trenching machine 10 can be seen having a digging boom 12 which is adapted to pivot about an axis 14 during a trenching operation.

A digging chain 16 is mounted on the digging boom 12, and is supported by a sprocket or guide wheel 18 at one end of the chain loop, and is drivingly engaged by another sprocket (not shown) at the other end of the chain loop. The chain 16 supports a plurality of cutter tools 20, which act on a surface 22 to be trenched when the boom 12 is lowered and the chain 16 is driven, during a trenching operation.

During trenching, friction is developed between the chain 16 and the lower portion 24 of the digging boom 12, where the chain 16 slidingly contacts the digging boom 12, while pressure is exerted from the chain 16 on the lower portion 24 of the digging boom.

Figure 2:
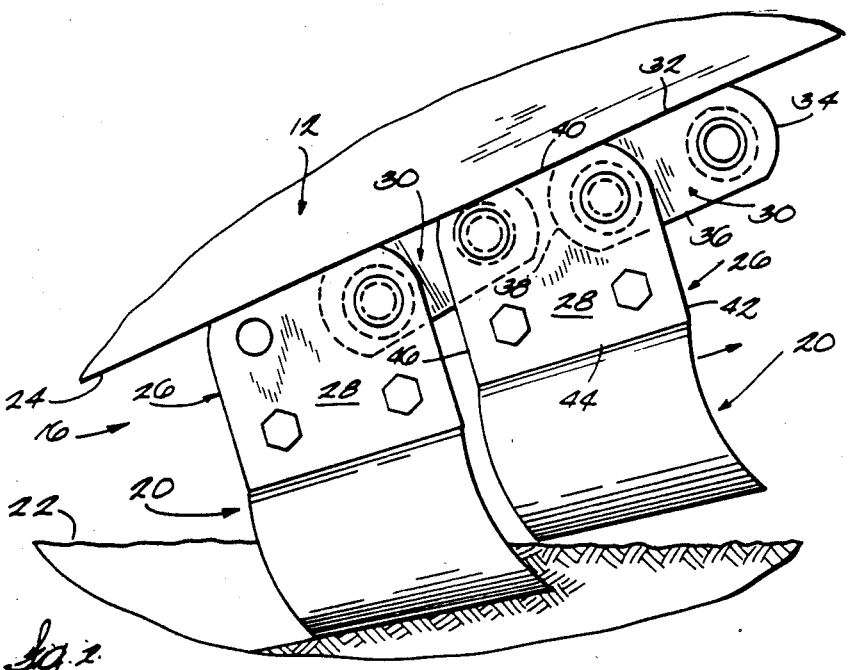
FIG. 2 is a side view of a broken away section of the chain used in the trenching machine shown in FIG. 1 and which shows chain wear patterns that result over time due to forces encountered by cutters supported by the chain as they contact the surface to be trenched.

As the cutter tools 20 contact the surface 22 being trenched, the cutter tools tend to cause backflex of the chain links supporting the cutter tools. Referring now to FIG. 2, it can be seen how the chain links tend to wear over time due to backflex that occurs as the cutter tools 20 contact the surface 22.

The chain 16 of the preferred embodiment of the invention is comprised of sidebars 26 that include a portion 28, to which the cutter tool 20 is attached, as well as connecting sidebars 30.

Each connecting sidebar 30 has a first edge 32, which slidingly contacts the boom 12, a leading periphery 34, an opposite edge 36, and a trailing periphery 38. As can be seen, the first edge 32 is subject to frictional forces at a portion thereof proximate to the leading periphery 34 of the connecting sidebar 30. Similarly, each sidebar 26, having a portion 28 for supporting a cutter tool 20, has a basis portion 29, a first edge 40, a leading periphery 42, an opposite edge 44, and a trailing periphery 46. In the drawings, the portion 28 of the sidebar 26 extends from, and is coplanar with the portion 29; however, it is envisioned that the portion 28 of the sidebar 26 could be bent at 90° relative to the basis portion 29, or could be welded to the portion 29. As can be seen, the first edge 40 is subject to frictional forces at a portion thereof proximate to the trailing periphery 46 of each sidebar 26 having a portion for supporting a cutter tool. Further, the leading periphery 34 of each connecting sidebar 30 and the trailing periphery 46 of each sidebar 26 having a portion for supporting a cutter tool are subject to frictional forces proximate to the first edges 32 and 40 of the sidebars.

Figure 3:
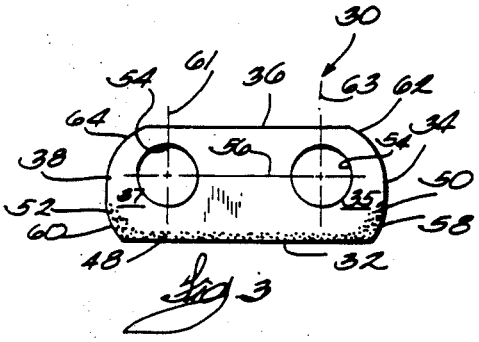
FIG. 3 shows in detail a side view of one of the connector sidebars of the chain shown in FIG. 2, without wear.

Referring now to FIG. 3, one of the connecting sidebars 30 shown in FIG. 2 can be seen in more detail. The sidebar 30 is induction hardened, in the preferred embodiment, along a portion 48 thereof extending from its first edge 32, for increased resistance to wear due to friction. Extending from the leading periphery 34 and trailing periphery 38 of the sidebar 30 are portions 50 and 52, respectively, which are induction hardened for increased resistance to wear, and which abut the portion 48 extending from the first edge 32 of the connecting sidebar 30. It is envisioned that portion 48 might not be induction hardened in some applications.

Pitch holes 54 are provided in the leading end 34 and trailing end 38, respectively, of sidebar 30 to allow the sidebar to be attached to the other sidebar of the pair of sidebars that form a link, as well as to a sidebar of another link in the chain 16. These pitch holes have centers on an axis 56 which is parallel to the first edge 32. The pitch holes are spaced from the first edge 32 by a distance greater than the distance between the pitch holes and the opposite edge 36. This provides an increased material thickness and permits increased chain wear before chain failure becomes likely.

As can be seen, the total portion of the sidebar 30 that is induction hardened is spaced from the pitch holes 54.

The sides 34 and 38 of the sidebar 30 include arcuate portions 58 and 60 intersecting the first edge 32, as well as arcuate portions 62 and 64, intersecting the opposite edge 36. While the arcuate portions 62 and 64 each have a center of curvature which is generally halfway between the first edge 32 and the opposite edge 36, the arcuate portions 58 and 60 each have a center of curvature which is below the axis 56. In FIG. 3, the arcuate portions 58 and 60 each have a center of curvature which is closer to the first edge 32 than to the opposite edge 36. This results in first edge 32 being longer than opposite edge 36. The pitch hole 54 through the trailing end 38 has a center that falls on a first transverse axis 61. The pitch hole 54 through the leading end 34 has a center that falls on a second transverse axis 63. The transverse axes 61 and 63 are perpendicular to the axis 56. The distance along the first edge 32 between the first transverse axis 61 and the trailing periphery 38 exceeds one half, and more particularly exceeds three quarters of the perpendicular distance between the axis 56 and the first edge 32. It has been found that this configuration results in reduced chain backflex, and therefore reduced chain wear.

Figure 4:
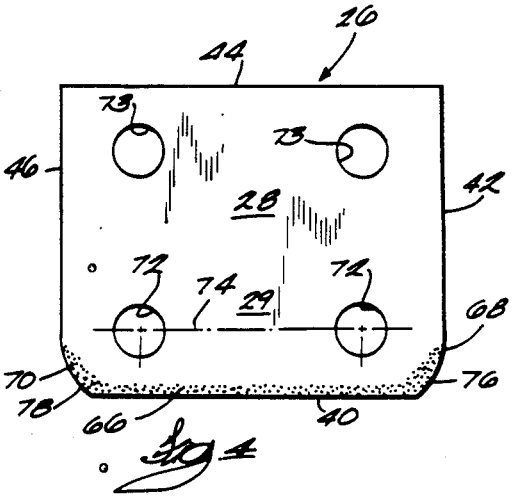
FIG. 4 shows in detail a side view of one of the tool supporting sidebars of the chain shown in FIG. 2, without wear.

Referring now to FIG. 4, one of the sidebars 26 shown in FIG. 2 and having a portion 28 for supporting a tool, is shown in detail. The sidebar 26 is induction hardened, along a portion 66 thereof extending from its first edge 40, for increased resistance to wear due to friction. Extending from the leading periphery 42 and the trailing periphery 46 of the sidebar 26 are portions 68 and 70, respectively, which are induction hardened for increased resistance to wear, and which abut the portion 66 extending from the first edge 40 of the sidebar 26.

Pitch holes 72 are provided in the basis portion 29 of the sidebar 26, which holes have centers along an axis 74 which is spaced apart from the first edge 40 by a distance which equals the distance that the axis 56 is separated from the first edge 32 of the connecting sidebar 30 shown in FIG. 3. Further, bolt holes 73 are provided in the portion 28 of the sidebar 26 to allow bolting of each cutter tool 20 to each sidebar 26. Alternately, cutter tools 20 could be welded to sidebars 26.

The sides 42 and 46 of the sidebar 26 include arcuate portions 76 and 78, respectively, ending at the first edge 40. The arcuate portions 76 and 78 each have a center of curvature which is spaced apart from the first edge 40 by a distance which equals the distance that the center of curvature of each of the arcuate portions 58 and 60 is separated from the first edge 32 of the connecting sidebar 30 shown in FIG. 3.

While a preferred embodiment of the invention has been disclosed, by way of example, various obvious modifications will become apparent to those skilled in the art. Thus, the scope of the invention should be limited only by the spirit and scope of the following claims.

We claim:

1. A chain comprising a plurality of chain links joined together by chain pins, at least one of the chain links including a sidebar having a first edge adapted to be supported in sliding contact with a supporting surface, said first edge being generally linear and extending in the direction of movement of the chain with respect to the support surface, and the sidebar including an opposite edge spaced from and generally parallel to said first edge, a trailing end having a first pitch hole therethrough and a leading end having a second pitch hole therethrough, the pitch holes housing said chain pins, and at least one of the leading end and the trailing end of the sidebar including an induction hardened portion adjacent the first edge.

2. A chain in accordance with claim 1 wherein said induction hardened portion of said sidebar further extends between said first edge and a line extending generally parallel to the first edge, the line being spaced between the pitch holes and the first edge.

3. A chain in accordance with claim 1 wherein said induction hardened portion is spaced from each of the pitch holes.

4. A chain in accordance with claim 1 wherein said trailing end includes an induction hardened portion, adjacent said first edge.

5. A chain in accordance with claim 4 wherein said leading end includes an induction hardened portion adjacent said first edge.

6. A chain in accordance with claim 1 wherein a length dimension is defined in the direction of chain travel, and wherein said first edge has a greater length than said opposite edge.

7. A chain in accordance with claim 1 wherein the first pitch hole is closer to the opposite edge than to the first edge.

8. A chain in accordance with claim 7 wherein the first pitch hole and the second pitch hole each have centers that lie on a longitudinal axis which is parallel to the first edge.

9. A chain in accordance with claim 1 wherein said sidebar has a longitudinal axis which is parallel to said first edge, and wherein the pitch hole through said leading end and the pitch hole through said trailing end each have centers that lie on the longitudinal axis, the longitudinal axis being closer to said opposite edge than to said first edge, said chain further comprising links adapted to support tools, wherein said links adapted to support tools comprise sidebars having an extended height portion extending in the direction transverse to the longitudinal axis, a leading end having a pitch hole therethrough which has a center on said longitudinal axis to allow linking with other sidebars, and a trailing end having a pitch hole therethrough which has a center on said longitudinal axis.

10. A chain comprising a plurality of chain links joined together by chain pins, at least one of the chain links including a sidebar having a first edge adapted to be supported in sliding contact with a supporting surface, said first edge being generally linear and extending in the direction of movement of the chain with respect to the support surface, and the sidebar including an opposite edge spaced from and generally parallel to said first edge, a trailing end having a first pitch hole therethrough, and a leading end having a second pitch hole therethrough, the pitch holes housing said chain pins, the first pitch hole having a center that lies on a longitudinal axis which is parallel to said first edge, said sidebar having at its trailing end a trailing periphery extending between said first edge and said opposite edge, wherein the center of the first pitch hole lies on a first transverse axis which is perpendicular to the longitudinal axis and which intersects said first edge, and the distance along said first edge between the first transverse axis and said trailing periphery exceeds half of the distance between the longitudinal axis and said first edge.

11. A chain in accordance with claim 10 wherein the distance along said first edge between the first transverse axis and said trailing periphery exceeds approximately three quarters of the perpendicular distance between the longitudinal axis and said first edge.

12. A chain in accordance with claim 10, said sidebar having at its leading end a leading periphery extending between said first edge and said opposite edge wherein the center of the pitch hole through said leading end of said sidebar lies on the longitudinal axis and lies on a second transverse axis which is spaced from and parallel to the first transverse axis, and the distance along said first edge between the second transverse axis and said leading periphery approximates the distance along said first edge between the first transverse axis and said trailing periphery.

13. A chain in accordance with claim 10, said trailing periphery having a first arcuate portion extending from said first edge, said first arcuate portion having a center of curvature that lies on the first transverse axis and that is located between the longitudinal axis and the first edge.

14. A chain in accordance with claim 13, said sidebar having at the leading end thereof a leading periphery extending between said first edge and said opposite edge wherein the center of the pitch hole through said leading end of said sidebar lies on the longitudinal axis and lies on a second transverse axis which is spaced from and parallel to the first transverse axis, said leading periphery having a second arcuate portion extending from said first edge, said second arcuate portion having a center of curvature that lies on the second transverse axis and that is located between the longitudinal axis and the first edge.

15. A chain in accordance with claim 14, wherein the centers of curvature on the first and second transverse axes are each closer to the first edge than to the opposite edge.

16. A sidebar for a chain comprising a plurality of chain links joined together by chain pins, said sidebar having a first edge adapted to be supported in sliding contact with a supporting surface, said first edge being generally linear, and the sidebar including an opposite edge spaced from and generally parallel to said first edge, a trailing end having a first pitch hole therethrough, and a leading end having a second pitch hole therethrough, the pitch holes being adapted to allow the sidebar to be joined to another sidebar by a chain pin, at least one of the leading end and the trailing end of the sidebar including an induction hardened portion adjacent the first edge.

17. A chain comprising a plurality of chain links joined together by chain pins, at least one of the chain links including a sidebar having a first edge adapted to be supported in sliding contact with a supporting surface, said first edge being generally linear and extending in the direction of movement of the chain with respect to the support surface, and the sidebar including an opposite edge spaced from and generally parallel to said first edge, a trailing end having a first pitch hole therethrough, and a leading end having a second pitch hole therethrough, the pitch holes housing said chain pins, said sidebar having at the trailing end thereof a trailing periphery extending between said first edge and said opposite edge wherein the center of the pitch hole through said trailing end of said sidebar lies on a first transverse axis which is perpendicular to the longitudinal axis and which intersects said first edge, said trailing periphery having a first arcuate portion extending from said first edge, said first arcuate portion having a center of curvature that lies on the first transverse axis and that is located between the longitudinal axis and the first edge, and the distance along said first edge between the first transverse axis and said trailing periphery exceeding half of the distance between the longitudinal axis and said first edge.

18. A chain in accordance with claim 17, said sidebar having at the leading end thereof a leading periphery extending between said first edge and said opposite edge wherein the center of the pitch hole through said leading end of said sidebar lies on the longitudinal axis and lies on a second transverse axis which is spaced from and parallel to the first transverse axis, said leading periphery having a second arcuate portion extending from said first edge, said second arcuate portion having a center of curvature that lies on the second transverse axis and that is located between the longitudinal axis and the first edge.

19. A chain in accordance with claim 17 wherein the centers of curvature on the first and second transverse axes are each closer to the first edge than to the opposite edge.

20. A chain in accordance with claim 10 wherein at least one of the leading end and the trailing end of the sidebar includes an induction hardened portion adjacent said first edge.

21. A chain in accordance with claim 20 wherein said induction hardened portion of said sidebar further extends between said first edge and a line extending generally parallel to said first edge, the line being spaced between the pitch holes and said first edge.

22. A chain in accordance with claim 20 wherein said induction hardened portion is spaced from each of the pitch holes.

23. A chain in accordance with claim 20 wherein said trailing end includes an induction hardened portion, adjacent said first edge.

24. A chain in accordance with claim 23 wherein said leading end includes an induction hardened portion adjacent said first edge.

25. A trenching machine comprising a digging boom, a driven sprocket at one end of the boom, a guide wheel at the other end of the boom, and a chain mounted on said sprocket and said guide wheel for rotation about said boom, said chain including a plurality of chain links joined together by chain pins, at least one of the chain links including a sidebar having a first edge supported in sliding contact with said boom, said first edge being generally linear and extending in the direction of movement of the chain with respect to the boom, and the sidebar including an opposite edge spaced from and generally parallel to said first edge, a trailing end having a first pitch hole therethrough and a leading end having a second pitch hole therethrough, the pitch holes housing said chain pins, and at least one of the leading end and the trailing end of the sidebar including an induction hardened portion adjacent the first edge.

26. A trenching machine in accordance with claim 25 wherein said induction hardened portion of said sidebar further extends between said first edge and a line extending generally parallel to the first edge, the line being spaced between the pitch holes and the first edge.

27. A trenching machine in accordance with claim 25 wherein said induction hardened portion is spaced from each of the pitch holes.

28. A trenching machine in accordance with claim 25 wherein said trailing end includes an induction hardened portion, adjacent said first edge.

29. A trenching machine in accordance with claim 28 wherein said leading end includes an induction hardened portion adjacent said first edge.

30. A trenching machine in accordance with claim 25 wherein a length dimension is defined in the direction of chain travel, and wherein said first edge has a greater length than said opposite edge.

31. A trenching machine in accordance with claim 26 wherein the first pitch hole is closer to the opposite edge than to the first edge.

32. A trenching machine in accordance with claim 31 wherein the first pitch hole and the second pitch hole each have centers that lie on a longitudinal axis which is parallel to the first edge.

33. A trenching machine in accordance with claim 25 wherein said sidebar has a longitudinal axis which is parallel to said first edge, and wherein the pitch hole through said leading end and the pitch hole through said trailing end each have centers that lie on the longitudinal axis, the longitudinal axis being closer to said opposite edge than to said first edge, said chain further comprising links adapted to support tools, wherein said links adapted to support tools comprise sidebars having an extended height portion extending in the direction transverse to the longitudinal axis, a leading end having a pitch hole therethrough which has a center on said longitudinal axis to allow linking with other sidebars, and a trailing end having a pitch hole therethrough which has a center on said longitudinal axis.

34. A trenching machine comprising a digging boom, a driven sprocket at one end of the boom, a guide wheel at the other end of the boom, and a chain mounted on said sprocket and said guide wheel for rotation about said boom, said chain including a plurality of chain links joined together by chain pins, at least one of the chain links including a sidebar having a first edge supported in sliding contact with said boom, said first edge being generally linear and extending in the direction of movement of the chain with respect to said boom, and the sidebar including an opposite edge spaced from and generally parallel to said first edge, a trailing end having a first pitch hole therethrough, and a leading end having a second pitch hole therethrough, the pitch holes housing said chain pins, the first pitch hole having a center that lies on a longitudinal axis which is parallel to said first edge, said sidebar having at its trailing end a trailing periphery extending between said first edge and said opposite edge, wherein the center of the first pitch hole lies on a first transverse axis which is perpendicular to the longitudinal axis and which intersects said first edge, and the distance along said first edge between the first transverse axis and said trailing periphery exceeds half of the distance between the longitudinal axis and said first edge.

35. A trenching machine in accordance with claim 34 wherein the distance along said first edge between the first transverse axis and said trailing periphery exceeds approximately three quarters of the perpendicular distance between the longitudinal axis and said first edge.

36. A trenching machine in accordance with claim 34, said sidebar having at its leading end a leading periphery extending between said first edge and said opposite edge wherein the center of the pitch hole through said leading end of said sidebar lies on the longitudinal axis and lies on a second transverse axis which is spaced from and parallel to the first transverse axis, and the distance along said first edge between the second transverse axis and said leading periphery approximates the distance along said first edge between the first transverse axis and said trailing periphery.

37. A trenching machine in accordance with claim 34, said trailing periphery having a first arcuate portion extending from said first edge, said first arcuate portion having a center of curvature that lies on the first transverse axis and that is located between the longitudinal axis and the first edge.

38. A trenching machine in accordance with claim 37, said sidebar having at the leading end thereof a leading periphery extending between said first edge and said opposite edge wherein the center of the pitch hole through said leading end of said sidebar lies on the longitudinal axis and lies on a second transverse axis which is spaced from and parallel to the first transverse axis, said leading periphery having a second arcuate portion extending from said first edge, said second arcuate portion having a center of curvature that lies on the second transverse axis and that is located between the longitudinal axis and the first edge.

39. A trenching machine in accordance with claim 38, wherein the centers of curvature on the first and second transverse axes are each closer to the first edge than to the opposite edge.

40. A trenching machine comprising a digging boom, a guide wheel at the other end of the boom and a chain mounted on said sprocket and said guide wheel for rotation about said boom, said chain including a plurality of chain links joined together by chain pins, at least one of the chain links including a sidebar having a first edge supported in sliding contact with said boom, said first edge being generally linear and extending in the direction of movement of the chain with respect to said boom, and the sidebar including an opposite edge spaced from and generally parallel to said first edge, a trailing end having a first pitch hole therethrough, and a leading end having a second pitch hole therethrough, the pitch holes housing said chain pins, said sidebar having at the trailing end thereof a trailing periphery extending between said first edge and said opposite edge wherein the center of the pitch hole through said trailing end of said sidebar lies on a first transverse axis which is perpendicular to the longitudinal axis and which intersects said first edge, said trailing periphery having a first arcuate portion extending from said first edge, said first arcuate portion having a center of curvature that lies on the first transverse axis and that is located between the longitudinal axis and the first edge, and the distance along said first edge between the first transverse axis and said trailing periphery exceeding half of the distance between the longitudinal axis and said first edge.

41. A trenching machine in accordance with claim 40, said sidebar having at the leading end thereof a leading periphery extending between said first edge and said opposite edge wherein the center of the pitch hole through said leading end of said sidebar lies on the longitudinal axis and lies on a second transverse axis which is spaced from and parallel to the first transverse axis, said leading periphery having a second arcuate portion extending from said first edge, said second arcuate portion having a center of curvature that lies on the second transverse axis and that is located between the longitudinal axis and the first edge.

42. A trenching machine in accordance with claim 41, wherein the center of curvature on the first and second transverse axes are each closer to the first edge than to the opposite edge.

43. A trenching machine in accordance with claim 34 wherein at least one of the leading end and the trailing end of the sidebar includes an induction hardened portion adjacent said first edge.

44. A trenching machine in accordance with claim 43 wherein said induction hardened portion of said sidebar further extends between said first edge and a line extending generally parallel to said first edge, the line being spaced between the pitch holes and said first edge.

45. A trenching machine in accordance with claim 43, wherein said induction hardened portion is spaced from each of the pitch holes.

46. A trenching machine in accordance with claim 43 wherein said trailing end includes an induction hardened portion, adjacent said first edge.

47. A trenching machine in accordance with claim 46, wherein said leading end includes an induction hardened portion adjacent said first edge.

* * * * *